United States Patent [19]

Wentzell

[11] Patent Number: 4,646,800

[45] Date of Patent: Mar. 3, 1987

[54] AUTOMATED LOG SPLITTER

[76] Inventor: Timothy H. Wentzell, 639 Governor's Highway, South Windsor, Conn. 06074

[21] Appl. No.: 759,303

[22] Filed: Jul. 26, 1985

[51] Int. Cl.[4] ..... B27L 7/00

[52] U.S. Cl. ..... 144/194; 74/15.63; 144/366; 180/53.7

[58] Field of Search ..... 144/2 N, 193 R, 194, 144/366; 74/15.6, 15.63; 180/53.7, 53.3

[56] References Cited

U.S. PATENT DOCUMENTS

| | | | |
|---|---|---|---|
| 2,746,492 | 2/1956 | Hardit | 144/2 N |
| 4,315,534 | 2/1982 | Blackstone | 144/194 |

FOREIGN PATENT DOCUMENTS

| | | | |
|---|---|---|---|
| 2462979 | 3/1981 | France | 144/194 |
| 2491811 | 4/1981 | France | 144/194 |

*Primary Examiner*—W. D. Bray

*Attorney, Agent, or Firm*—L. James Ristas

[57] ABSTRACT

A log splitting apparatus and method for use in conjunction with a substantially horizontally mounted source of rotational power, such as the take off (20) and hitch lift unit (16) of a farm type tractor (10). The apparatus is disclosed in the form of a rigid frame (30) attached to the unit (16), and includes strut members (26,28) for maintaining the frame in a horizontal orientation. A drive shaft (60) is horizontally supported through the frame with one end connected as a universal joint (40) to the take off, and the other end extending behind the frame. A drive transfer gear arrangement (42) is connected to the extending end of the drive shaft, and an auger (44,46) is perpendicularly connected to the transfer gear arrangement. Preferably, the tractor is maneuvered to straddle a series of end-to-end logs (12) so that the auger (46), while pointing downward and rotated by the power take off and drive shaft, is lowered onto and lifted from each log in succession, by means of the lift unit. After the logs have been split, the frame or auger can be remounted to point upward so that the log segments can be further split by manual placement on the rotating auger. Two embodiments are shown for remounting the auger, the first having an auger pivot assembly (54) on a stationary frame, and the second requiring unitary reversal of the frame, drive gear arrangement, and auger.

16 Claims, 10 Drawing Figures

AUTOMATED LOG SPLITTER

BACKGROUND OF THE INVENTION

This invention relates to automated log splitters, and more particularly, to the type adapted for connection to the power take off on a conventional farm tractor or the like.

Although log splitter tools or equipment have for some time been available for use in connection with the power take off assemblies on tractors, such conventional devices have required substantial manual effort, especially for making the initial split of each log. Auger heads on these devices have typically been horizontally oriented, in parallel with support or guide means for preventing the log from twisting off the splitting apparatus as the auger penetrates and splits the log. In order to supply power to the auger head, the auger head was generally in horizontal alignment with the power take off drive gear or univeral joint, and thus at least one foot above the ground. The operator had to lift the log at least about one foot in order to locate it adjacent to the auger head and initiate penetration. When log splitting is to be done on a production basis alongside felled trees, each log cut along the tree length can easily exceed fifty pounds. Manual lifting of these logs prior to the first split operation can quickly tire the operator, and limit production.

Typical examples of the prior art log splitting equipment adapted for use with a tractor or other source of rotating shaft, may be found in the promotional literature for the LOG AUG splitter, a product of SAK Manufacturing Division of El Fuego Corporation.

SUMMARY OF THE INVENTION

The present invention eliminates the need for manual lifting or positioning of the logs to be split, by providing a vertically downward orientation of the auger head. In conjunction with selective positioning and actuation of the hydraulic hitch lift unit typically found on farm tractors, the logs can be initially penetrated and split while they lie on the ground. In a production environment, the tractor straddles a felled tree that has been transversely cut into logs, and it splits each log in sequence as it moves along the tree length. At each log location, the downwardly oriented, rotating auger is lowered onto and through the log, by the hitch lift unit.

After the logs have been initially split, they can be handled manually with greater ease, such that increased throughput can be obtained by keeping the rotating auger stationary, while manually feeding log sections to be further split. With the present invention, the apparatus can be remounted on the tractor to a horizontal orientation or, preferably, to a vertical orientation with the auger pointing upward. In this mode, the operator need only place, or lightly drop, a log section onto the rotating auger. The weight of the log section is typically sufficient to enable the auger to penetrate and further split the log section into saleable and directly burnable sizes.

In broad terms, the invention is an apparatus for attachment to a substantially horizontally mounted source of rotational power. It includes a horizontally oriented drive shaft including a universal joint connection to the power source. A frame and associated support structure supports the drive shaft and a drive transfer gear arrangement for transforming the rotational axis of the power source, from horizontal to vertical. An auger assembly including an auger shaft and head extends vertically from the drive gear arrangement for penetrating the log to be split. To prevent the log from rotating while the auger head penetrates, a guide bar assembly extends to a location near the auger head.

In a method embodiment, the invention includes the steps of mounting the apparatus on a tractor so that the auger is above the ground and pointing vertically downward, then moving the tractor toward the log until the auger is directly over the log. The auger is rotated and simultaneously lowered onto the log until the log is split. The auger is raised and the tractor is moved until the auger is above another log. This sequence of raising the auger, moving the tractor, and splitting the log is repeated until all logs have been split.

BRIEF DESCRIPTION OF THE DRAWINGS

The preferred embodiments of the invention, and the best mode for carrying them out, will be described in greater detail with reference to the accompanying drawings, in which.

DESCRIPTION OF THE PREFERRED EMBODIMENTS

Figure 1:
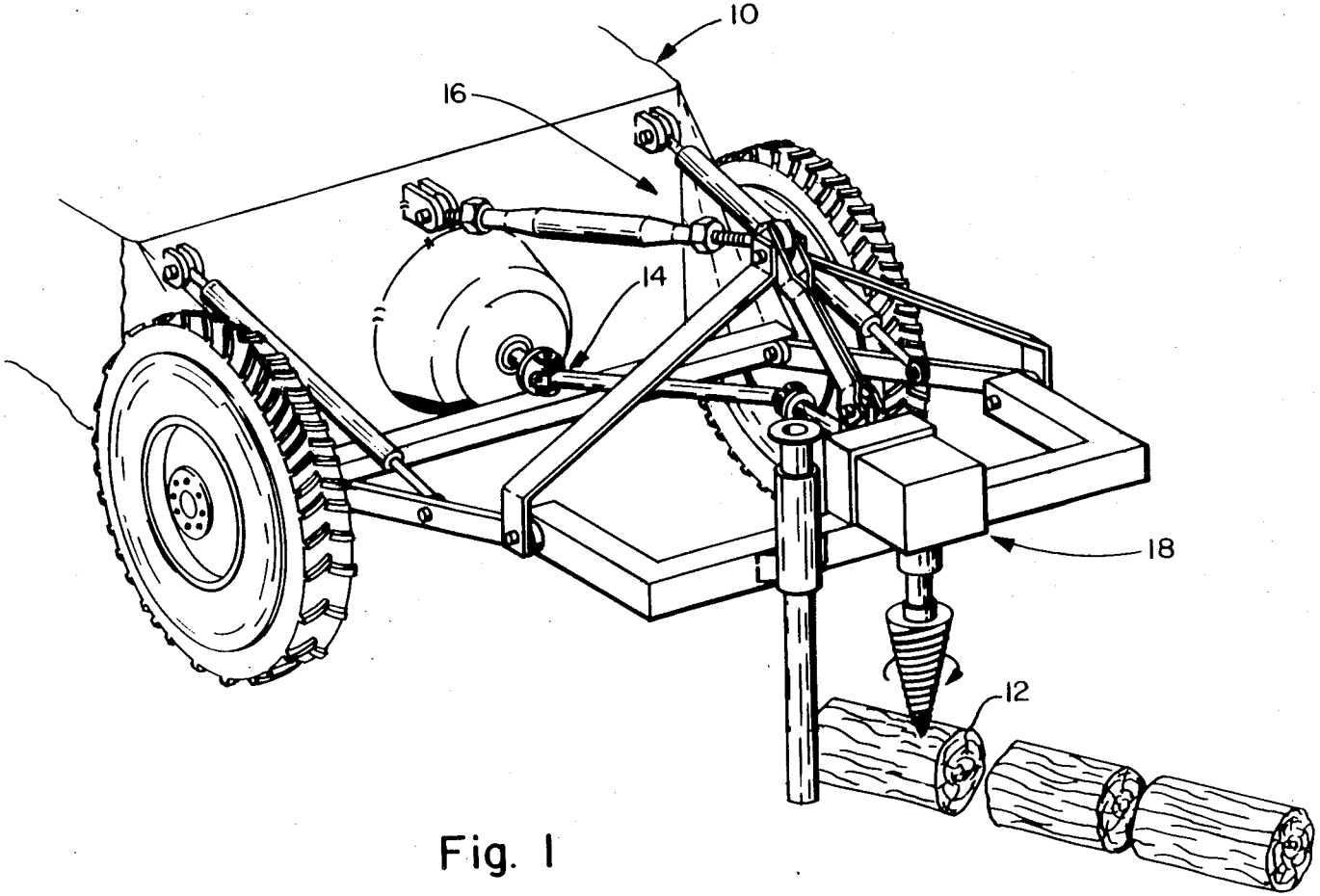
FIG. 1 is a sketch of the inventive apparatus as mounted to the power take off and hitch lift unit of a farm tractor, showing the tractor poised to move backward while stradling a row of logs to be split.

FIG. 1 shows a farm type tractor 10 poised to straddle a row of logs 12 from a felled tree, preparatory to splitting the logs in accordance with the present invention. The tractor 10 typically includes as conventional equipment, a power take off assembly 14 and a hitch lift unit 16, to which the apparatus of the present invention is operatively connected. As will be described more fully below, the auger drive assembly 18 of the present invention is automatically deployed by the operator of the tractor 10, to sequentially split the logs 12 while they are on the ground.

Figure 2B:
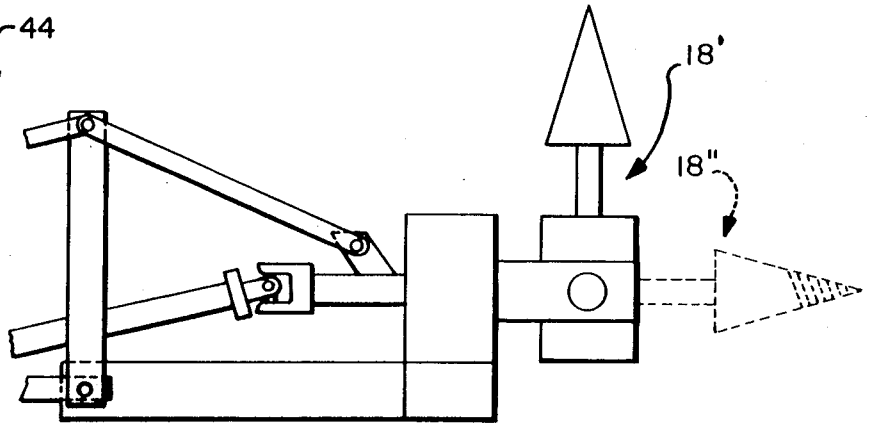
FIGS. 2*a* and 2*b* are schematic representations of a first embodiment of the invention, showing the auger head pointing downward and, in a remounted position, pointing upward, respectively.
Figure 2A:
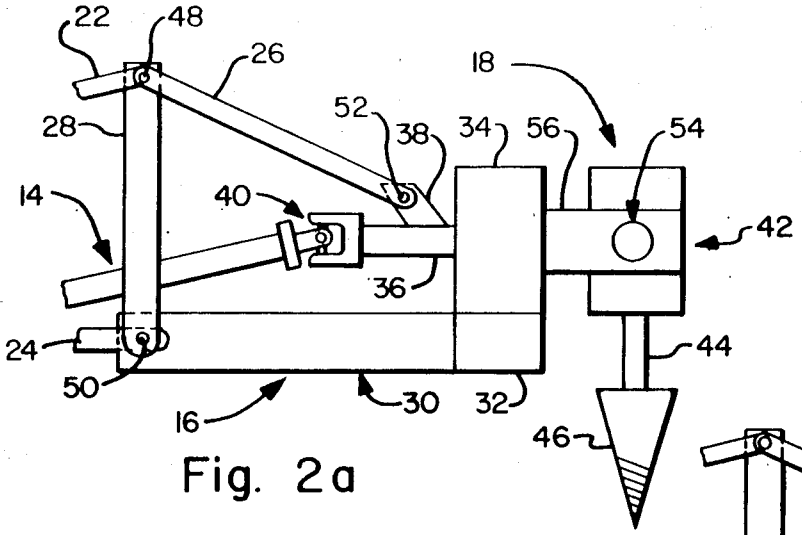

FIG. 2*a* shows schematically, a first embodiment of the invention, in which the auger assembly 18 may be selectively reoriented from a down position adapted to split the logs as shown in FIG. 1, to an up position 18' (or horizontal position 18'') shown in FIG. 2*b*, which is adapted to split intermediate-size log sections into small log segments.

The hitch lift unit 16 comprises a hitch lift 22 and support arms 24, of a type conventionally found on tractors. The hitch arm 26 and hitch struts 28 constitutes strut means which may be part of the tractor equipment, or associated with the apparatus of the present invention. The hitch lift unit 16 and strut means 26,28 are adapted to support a rigid splitter frame 30 in a generally horizontal orientation behind the tractor, and to lift and lower the frame relative to the ground while maintaining the frame horizontal.

The power take off assembly 14 terminates in what is commonly referred to as the take off 20, which is substantially horizontally oriented and is a source of rotating power to which the auger drive assembly 18 is connected. The drive assembly 18 is carried on the frame 30, which preferably includes a base portion 32 on which is mounted a drive bushing support 34 and drive shaft bushing 36. The frame 30 is preferably connected to the hitch arm 26 by means of a lug fin 38 projecting from the bushing 36.

The drive assembly 18 includes a universal joint connection 40 to the take off 20, a drive transfer gear arrangement 42, a auger shaft 44 connected to the gear arrangement 42 and an auger head 46 of the type used in conventional auger-type log splitters. The frame 30 and drive asembly 18 carried thereon, are preferably pivotally connected to the tractor, as by hitch pivot 48, frame pivot 50, and lug pivot 52.

Figure 6:
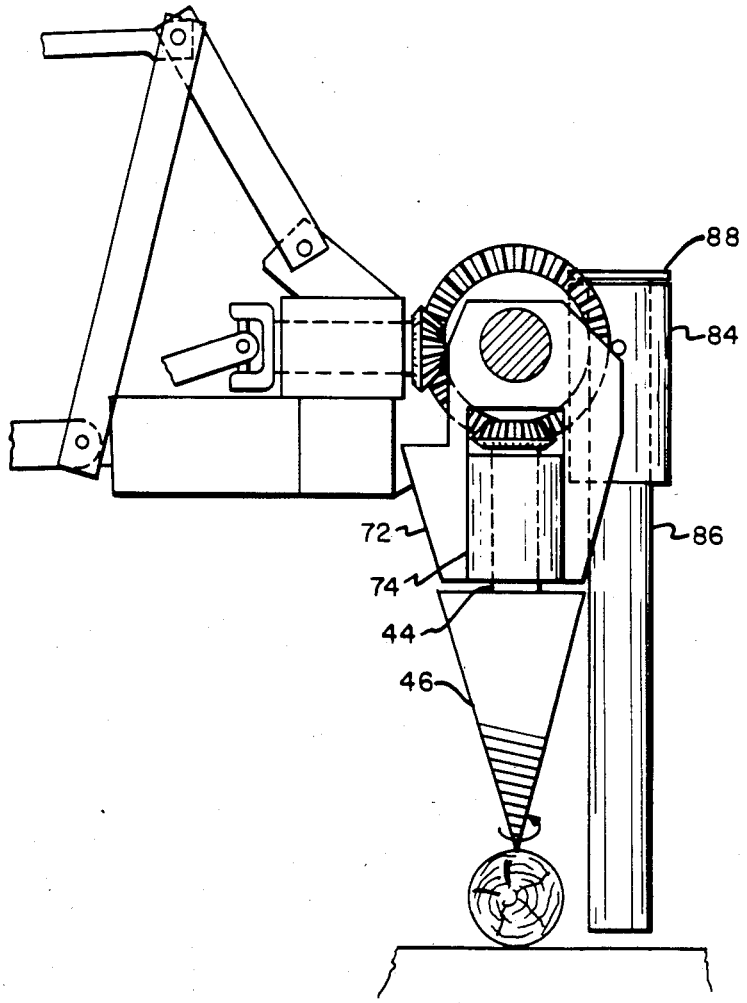
FIG. 6 is a side view of the invention shown in FIG. 4, with the auger pointing downward.
Figure 7:
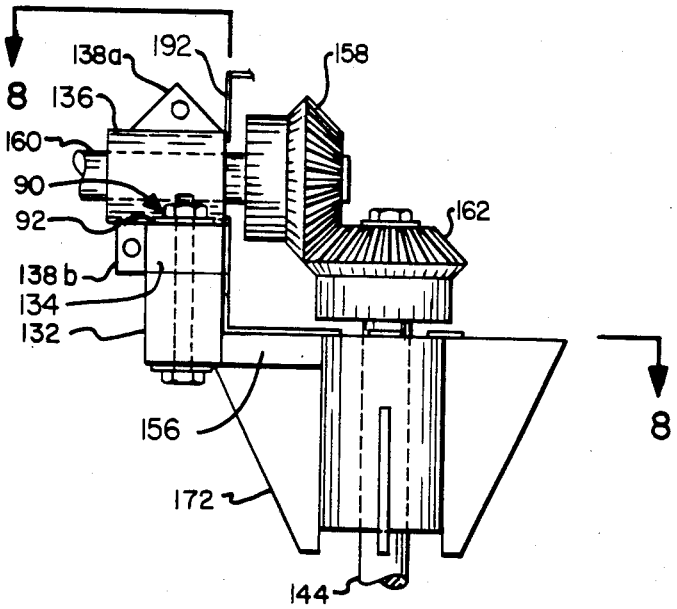
FIG. 7 is a side view of the frame, gear arrangement, and auger housing associated with a second embodiment of the invention.
Figure 8:
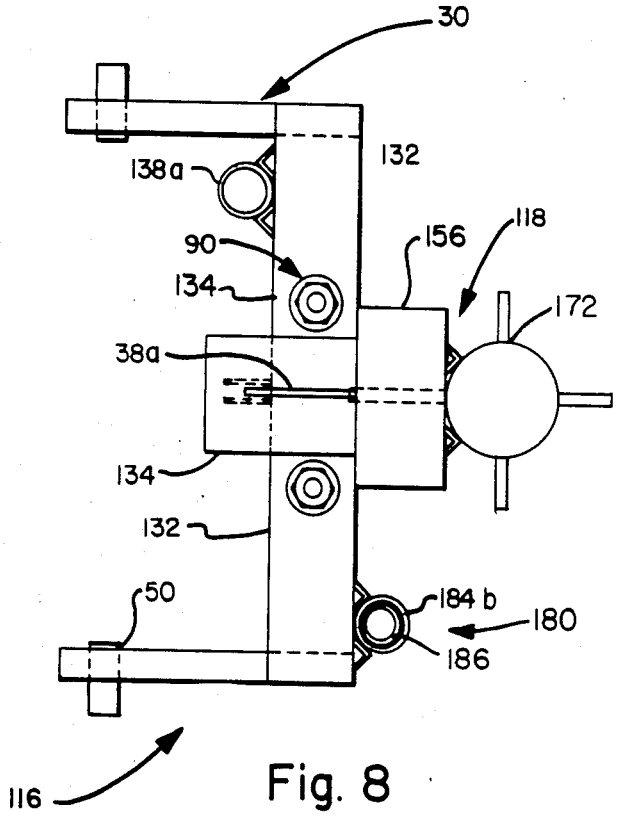
FIG. 8 is a plan view of the portion of the invention apparatus shown in FIG. 7, with the gear arrangement omitted for clarity.

The feature distinguishing the first embodiment of the invention as described in connection with FIGS. 2 and 4–6, from the second embodiment described in connection with FIGS. 3, 7 and 8, is the means by which the auger 46 may be reoriented from the down position to the up or horizontal positions, as shown in FIG. 2*b*. An auger pivot assembly 54 is mounted on a brace member 56 carried on the frame 30, such that the gear arrangement 42 can be selectively locked in the downward and at least one of the horizontal or up positions.

Figure 3B:
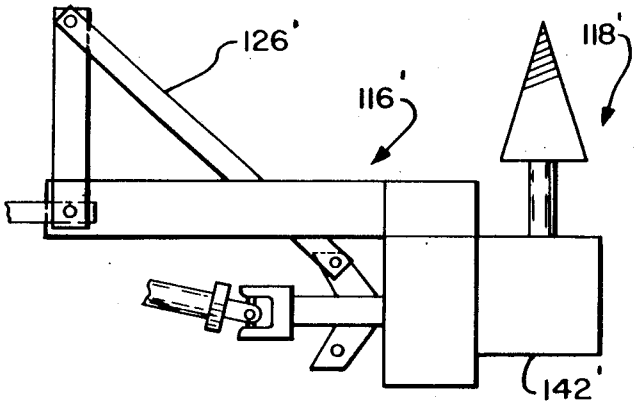
FIGS. 3*a* and 3*b* are schematic representations of a second embodiment of the invention, showing the auger head pointing downward and, in a remounted position, pointing upward, respectively.
Figure 3A:
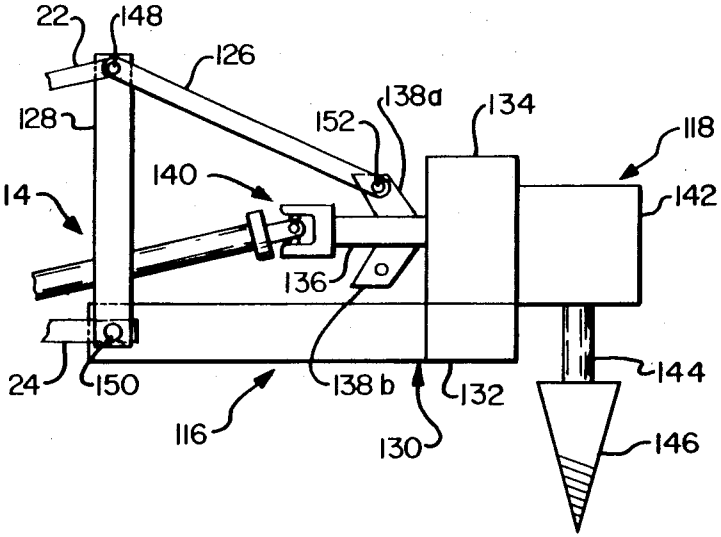
Figure 4:
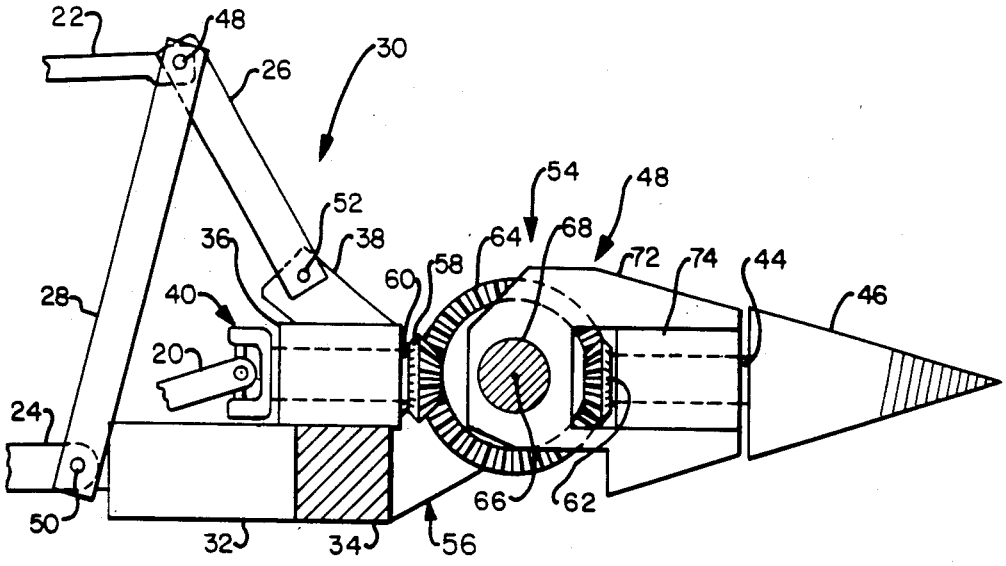
FIG. 4 is a side view of the first embodiment of the invention, with the auger pointing horizontally.
Figure 5:
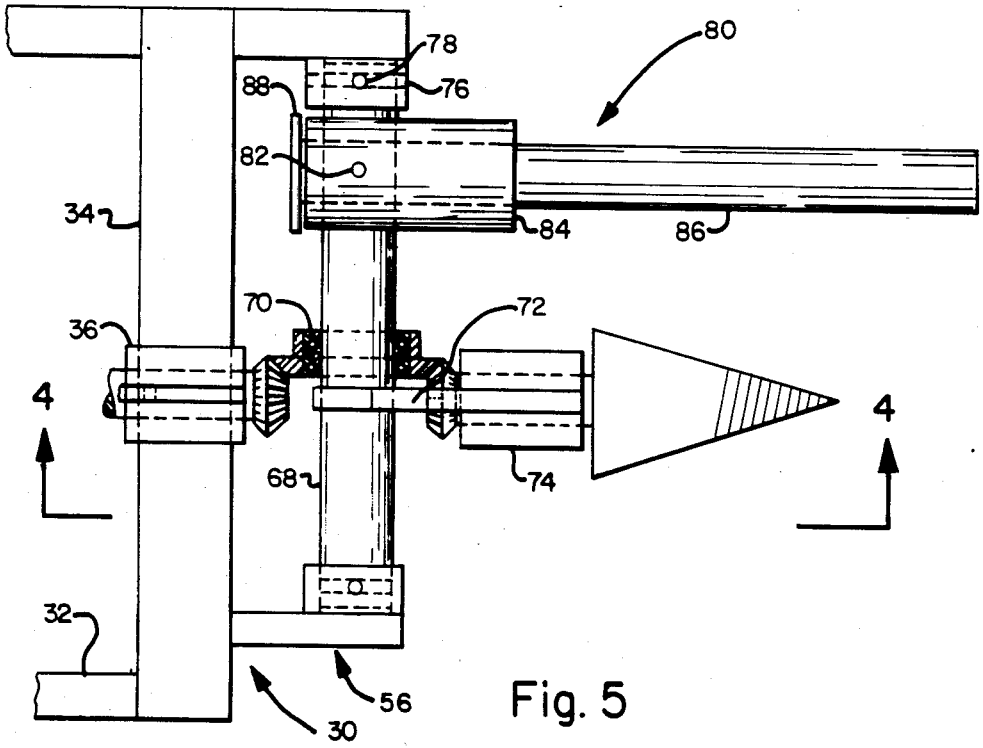
FIG. 5 is a plan view of the embodiment shown in FIG. 4.

FIGS. 3, 4, and 5 illustrate the first embodiment of the invention in greater detail. The drive shaft 60 is connected at one end to the universal joint 40 and at the other end to a first bevel gear 58 that is coaxial with the shaft 60. The shaft 60 is supported by the bushing 36 carried on the bushing support member 34 on base member 32. Other arrangements of these shaft support members are also possible without departing from the scope of the invention.

A second bevel gear 62 is attached to one end of the auger shaft 44, and a central or third bevel gear 64 is meshed with the first and second gears. It may be appreciated that the second gear 62 is adapted to remain engaged with the central gear 64 when the auger shaft 44 is repositioned as shown in FIGS. 2*a* and 2*b*.

As more easily seen in FIG. 5, the central gear 64 rotates about the axis 66 of bar member 68, by means of bushing 70 mounted on the bar member. The bar member 68 also rigidily supports the auger housing 72, which supports an auger bushing 74 through which the auger shaft 44 rotates. The transfer gear arrangement 42 and auger pivot assembly 54 are thus supported by the bar member 68, which is in turn supported in sleeve members 76 carried by bracing structure 56. When the auger pivot assembly 54 is the be repositioned, the locking means 78 between the sleeve and bar are released, the entire bar member 68 and supported structure are rotated one quarter or one half turn to a new position such as shown in FIG. 6. The bar 68 is again locked to the sleeve prior to beginning a new splitting operation.

As is known in this art, the use of a log anti-rotation assembly 80 to cooperate with the auger head 46, is preferred. A guide bar sleeve 84 is rigidly connected to any convenient rigid structure, such as the bar member 68, and a guide bar 86 having a cap 88 is slidably disposed therein. As shown in FIG. 6, the guide bar 86 is adapted to extend generally parallel with the auger head 46 to a location near the head such that the log 12 will abut the guide bar should it begin rotating on the ground as the auger head penetrates and advances through the log.

FIGS. 3,7 and 8 illustrate the second embodiment of the invention. In these figures, reference to structure typically associated with the tractor, will be made using the same numeric identifiers used in connection with FIGS. 1,2, and 4–6. Reference to structure similar or analogous to sructure described in connection with the first embodiment of the inventive log splitting apparatus, will carry similar two digit numeric identifiers plus 100. Structure found in the second embodiment but not the first, will have a three digit numeric identifier with no correspondence to identifiers in FIGS. 1,2, and 4–6.

Referring now to FIG. 3, there is illustrated in schematic representation, the features of the second embodiment that enable the operator to reverse the orientatin of the auger head from a down to an up position. In general, the auger shaft 144 is secured in fixed relation to the spliter frame 130. The frame 130 includes means 138*a*,138*b*, for selective attachment to the strut means 126,128 and hitch lift unit 116, so that the auger drive assembly 118 points downward when the hitch lift unit 116 has an upright orientation aas shown in FIG. 3*a*, and the drive assembly 118' points upward when the hitch lift unit 116' as a reversed orientation. This reversal is accomplished by disengaging the the pivot connections 148, 150 and 152 so that only the univeral joint 140 connects the splitter apparatus to the tractor equipment. The frame 130 is then rotated 180 degrees around the universal joint 140. The pivot joints are remade as shown in FIG. 3*b*. An important feature in the illustrated embodiment, is the double lug fins 138*a*,138*b* mounted 180 degrees apart on the drive shaft bushing 136. This assures that the bushing support member 134 and the auger drive asembly 118, are maintained "square" so that the auger shaft 144 is vertical. Other means besides the illustrated lugs could be employed on the bushing or elsewhere on the frame, for this purpose.

It should be appreciated that, to make the transition from the configuration shown in FIG. 3*a* to that shown in FIG. 3*b*, the power take off assembly 14 and support arms 24 and hitch lift 22, would typically require vertical adjustment. In most cases, this means longer hitch arm 126' is needed. Alternatively, an asymmetric fin member 138*b* or extension link between the arm 126 and fin 138*b* can be used (not shown).

FIG. 7 shows the preferred details of the auger drive assembly 118, and FIG. 8 shows a view from above the apparatus, with the gear structure omitted, so that the support for the auger housing 72 may be seen.

In FIG. 7, the drive shaft 160 is shown in phantom rotatingly supported within the drive shaft bushing 136 which is mounted, as by bolt means 190, to bushing support member 134 secured to base memberr 132. The gear box 192 protectively covers the first bevel gear 158 at the end of and coaxial with the dirve shaft 160, which is meshed with a second bevel gear 162 mounted coaxially at the end of the auger shaft 144 opposite the auger head (not shown). Other gear arrangements are possible, to transform the generally horizontal take off power delivered through the drive shaft 160, to vertically oriented power for rotating the auger as desired. In this second embodiment, there is no need for structure found in the auger pivot assembly of the first embodiment (i.e., structure 54 in FIG. 4), since the equivalent function is performed by reversing the orientation of the entire apparatus.

The brace member 156 supports the gear box 192 and serves as a rigid brace to which the auger housing 172 is connected as by welding to intermediate angle irons, as shown in FIG. 8. The structure shown in FIG. 7 must be sturdy enough to withstand the stresses of the log splitting operations and the structural weight, in both orientations shown in FIGS. 3*a* and 3*b*.

The anti-rotation assembly 180 of the second embodiment preferably includes two guide bar sleeves 184, one affixed to each side of the base member 132. Depending on whether the auger is oriented upwardly or downwardly, a guide bar 186 will be inserted through one or the other of the sleeves 184.

It may thus be appreciated that the invention as described herein is well suited to accomplish the automatic splitting of logs into sections, without the need for lifting the logs from the ground. Furthermore, by reorienting the apparatus so that the auger points upward or horizontally, the log sections can easily be further split into log segments.

What is claimed is:

1. A log splitting apparatus for attachment to the power take off (20) and tractor hitch lift unit (16) of a farm type tractor (10), comprising:

a rigid frame (30) attachable to said unit (16) to extend generally horizontally behind the tractor (10);

strut means (26,28) pivotally connected to the frame (30) and attachable to said unit (16) for maintaining the frame (30) in substantially horizontal orientation independent of the vertical position of said lift unit (16);

a drive shaft (60) horizontally supported through the frame (30), having one end connectable as a universal joint (40) to the power take off (20), and the other end extending behind the frame;

a drive transfer gear arrangement (42) connected to said other end of the drive shaft;

an auger shaft (44) connected at one end to the drive transfer gear arrangement and extending perpendicularly to the drive shaft;

an auger head (46) rigidly extending from the auger shaft for rotation in direct response to rotation of the take off and drive shaft;

said frame (30) further including means (54, or 138*a*, 138*b*) for reversing the orientation of the auger assembly between vertically downward and at least one of horizontal or upward positions:

whereby the auger head may be selectively driven through a log located on the ground below the transfer gear arrangement, or a log supported directly behind or directly above the transfer gear arrangement.

2. The apparatus of claim 1, wherein said means for reversing the orientation includes brace means (56) pivotally supporting the transfer gear arrangement (42) for selectively locking the gear arrangement in in any one of said positions.

3. The apparatus of claim 2, wherein said drive transfer gear arrangement (42) includes a first bevel gear (58) at the end of and coaxial with the drive shaft (60), a second bevel gear (62) at the end of and coaxial with the auger shaft (44), and a third, central bevel gear (64) supported by said brace means (56) on an axis (66) perpendicular to the axes of the first and second bevel gears and meshed therewith.

4. The apparatus of claim 3 wherein said second bevel gear (62) is supported by a bar member (68) mounted on said brace means (56) for selective pivotal movement about the axis of said third bevel gear.

5. The apparatus of claim 4, wherein said auger shaft (44) is carried within an auger bushing member (74), the bushing member being supported by an auger housing (72) rigidly connected to said bar member (68).

6. The apparatus of claim 5, wherein said central bevel gear (64) is attached to a gear bushing member (70) for rotation about the longitudinal axis (66) of the bar member (68).

7. The apparatus of claim 6, wherein said brace means (56) includes sleeve members (76) for supporting the bar member (68), the sleeve members and bar member having means (78) thereon for selectively locking the bar to the sleeve in a plurality of rotated positions.

8. The apparatus of claim 7, further including a guide bar sleeve (84) carried by the frame (56) and a guide bar (86) slidably disposed within the sleeve, the guide bar adapted to be selectively oriented in each of the orientations of the auger head (46) to cooperate therewith in the log splitting operation.

9. The apparatus of claim 8, wherein said frame (30) includes a drive shaft bushing (36) supporting the drive shaft (60) and a lug fin (38) on the upper surface of the shaft bushing for pivotally connecting (52) the frame to the strut means (26).

10. The apparatus of claim 9, wherein said frame (30) includes a base section (32,34) carrying the drive shaft bushing (36), and said brace means (56) is rigidly attached to and extends behind the base section.

11. The apparatus of claim 1, wherein said auger shaft (144) is secured in a fixed orientation relative to said frame (130), and said frame includes means (138*a*,1338*b*) thereon for selective attachment to said strut means (126,128) and unit in either an upright (118) or reversed (118') position such that the auger head (146) points either downward or upward, respectively.

12. The apparatus of claim 11, wherein said means for selective attachment include a first lug fin (138*a*) projecting upwardly from said frame and a second lug fin (138*b*) projecting 180 degrees away from said first fin, for selective attachment to said strut means (126) when the frame is in the upright and reversed positions, respectively.

13. The apparatus of claim 12, wherein said frame includes a base section (132, 134) for pivotal attachment to said strut means (128), a drive shaft bushing member (136) serving to support the drive shaft (160) and said lug fins (138*a*,138*b*).

14. The apparatus of claim 13, wherein said drive transfer gear arrangement (142) includes a first bevel gear (158) mounted coaxially at said other end of the drive shaft (160) and meshed with a second bevel gear (162) mounted coaxially at the end of the auger shaft (144) opposite the auger head (146).

15. The apparatus of claim 14, wherein said first and second bevel gears are enclosed within a box (96) supported by a ledge member (94) rigidly mounted to said frame (156).

16. The apparatus of claim 15, wherein said auger shaft (144) is rotatingly supported within an auger bushing member (174), the bushing member being supported by an auger housing (172) rigidly connected to said frame (130).

* * * * *